US006364201B1

(12) United States Patent
Varano

(10) Patent No.: US 6,364,201 B1
(45) Date of Patent: Apr. 2, 2002

(54) DISPOSABLE ALL-PURPOSE CONTAINER ASSEMBLY

(76) Inventor: Richard F. Varano, 156 Waterville Rd., Avon, CT (US) 06001

( * ) Notice: Subject to any disclaimer, the term of this patent is extended or adjusted under 35 U.S.C. 154(b) by 0 days.

(21) Appl. No.: 09/658,081

(22) Filed: Sep. 11, 2000

Related U.S. Application Data

(63) Continuation-in-part of application No. 09/121,934, filed on Jul. 24, 1998, now Pat. No. 6,116,503.

(51) Int. Cl.[7] ..... B65D 3/12; B65D 3/28

(52) U.S. Cl. ..... 229/198.2; 229/4.5; 229/5.5; 229/400

(58) Field of Search ..... 229/4.5, 5.5, 5.8, 229/5.84, 198.2, 400

(56) References Cited

U.S. PATENT DOCUMENTS

| | | | | |
|---|---|---|---|---|
| 1,771,765 A | | 7/1930 | Benson | |
| 2,623,444 A | * | 12/1952 | Maier et al. | 229/198.2 |
| 2,661,889 A | | 12/1953 | Phinney | |
| 2,775,382 A | | 12/1956 | Kavat | |
| 2,970,736 A | * | 2/1961 | Baughan | 229/5.84 |
| 2,988,967 A | | 6/1961 | Dudnick et al. | |
| 3,137,431 A | | 6/1964 | Crouse et al. | |
| 3,182,882 A | * | 5/1965 | Aellen, Jr. et al. | 229/5.5 |
| 3,581,972 A | * | 6/1971 | Buchner | 229/4.5 |
| 3,908,523 A | | 9/1975 | Shikava | |
| 4,102,454 A | | 7/1978 | Karevaara | |
| 4,211,339 A | * | 7/1980 | Itoh | 229/400 |
| 4,230,235 A | | 10/1980 | DiAmico | |
| 4,836,400 A | * | 6/1989 | Chaffey et al. | 229/400 |
| 4,934,591 A | | 6/1990 | Bantleon | |
| 5,147,067 A | | 9/1992 | Effertz | |
| 5,203,492 A | * | 4/1993 | Schellenberg | 229/5.5 |
| 5,697,550 A | | 12/1997 | Varano et al. | |
| 5,725,916 A | * | 3/1998 | Ishii et al. | 229/400 |
| 6,116,503 A | * | 9/2000 | Varano | 229/5.84 |

FOREIGN PATENT DOCUMENTS

DE 2.716.351 A1 10/1977

* cited by examiner

*Primary Examiner*—Gary E. Elkins
(74) *Attorney, Agent, or Firm*—McCormick, Paulding & Huber LLP

(57) ABSTRACT

A disposable all-purpose container assembly includes a disposable frustoconical container formed from polymer coated paper and a saddle-like insulation attachment straddling an associated portion of the container sidewall and mounted in fixed position on the sidewall. A raw edge of the sidewall blank is sealed with polymer tape to prevent wicking or migration of liquid from the container into the sidewall. The tape also enhances the bond along the sidewall seam. The insulation attachment has a plurality of spaced apart ribs which engage the outer surface of the sidewall. The ribs, and portions of the outer surface of the sidewall and inner surface of the insulation attachment define air spaces between the container and the insulation attachment. The insulation attachment has a pair of handle sections movable to a holding position for optional use. A ribbed insulation sleeve provided with the handle sections foldable to a holding position to form a handle for optional use on a frustoconical all-purpose container of disposable type is also disclosed. The selective use of polymers having both high and low melting temperatures enables the use of a wide range of polymer coating materials for coating the interior surfaces of the container.

14 Claims, 3 Drawing Sheets

DISPOSABLE ALL-PURPOSE CONTAINER ASSEMBLY

CROSS REFERENCE TO RELATED APPLICATION

This application is a continuation-in-part of application Ser. No., 09/121,934 filed Jul. 24, 1998 U.S. Pat. No. 6,116,503.

FIELD OF THE INVENTION

This invention relates in general to disposable paper containers or cups.

BACKGROUND OF THE INVENTION

Schools, hospitals and other like institutions charged with the responsibility for serving food to large numbers of persons are faced with the ever increasing cost of labor associated with food preparation and service. The goal of serving wholesome food products, without risk of contamination, at reasonable cost may best be realized by minimizing food handling. In hospitals, for example, where dietary control and food quantity intake are of essential importance the advantage of using pre-prepared food products prepared under carefully controlled conditions for direct service from the original containers in which the food products are stored is readily recognized. The present invention is concerned with the aforedescribed general problems.

Accordingly, it is the general aim of the present invention to provide an improved disposable all-purpose container which may serve both as a package for a pre-prepared food product and as a serving container for the food product. A further aim of the present invention is to provide an all-purpose container for a product which may be stored in a frozen condition or under refrigeration to be served cold or which may be heated in the container by a microwave process or in a conventional convection oven to be served hot or in a warm condition. Yet another aim of the invention is to provide such a container which may be employed as a package for a dried or dehydrated product which is activated by adding hot or cold water or other liquid to the product while the product remains in the container and which may then be served in the container in either hot or cold condition.

SUMMARY OF THE INVENTION

In accordance with the present invention, a disposable all purpose container assembly is provided which includes a container formed from polymer coated paper and has a generally circular bottom wall and a frustoconical sidewall. A raw edge of the sidewall blank from which the sidewall is formed is sealed with low density polyethylene tape which also enhances the bond between overlapping ends of the sidewall blank at the sidewall seam. The sidewall includes an integral annular rim which coaxially encircles the upper end of the container and defines a circular opening at the upper end. A saddle-like insulation attachment straddles an associated portion of an outer surface of the sidewall and is mounted in fixed position on the sidewall outer surface. The insulation attachment has a plurality of spaced apart ribs which extend along and project from the inner surface of the insulation attachment and engage the sidewall outer surface. The ribs and portions of the sidewall outer surface and the insulation attachment inner surface define air spaces between the container and the insulation attachment. The attachment is disposed solely to one side of an axial plane through the container and may include a handle formed by two handle sections integrally connected to the insulation attachment. In accordance with a further embodiment of the invention, the attachment may comprise a frustoconical ribbed sleeve which is received on and coaxially surrounds the container sidewall and defines a pair of handle sections for optional use. The selective use of polymers having both high and low melting temperatures enables the use of a wide range of polymer coating materials for coating the interior surfaces of the containers.

DETAILED DESCRIPTION OF PREFERRED EMBODIMENTS

Figure 1:
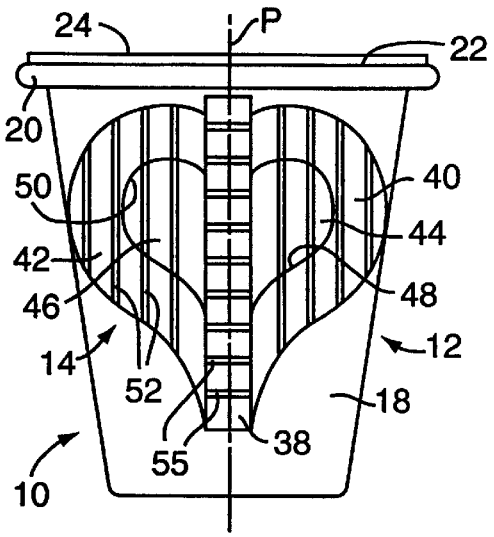
FIG. 1 is a fragmentary front elevational view of a disposable all-purpose container assembly embodying the present invention.

Turning now to the drawings and referring first particularly to FIGS. 1–4, a disposable all-purpose container assembly embodying the present invention is indicated generally by the reference numeral 10. The illustrated container assembly 10 essentially comprises a container or cup designated generally by the numeral 12 and an insulation/handle attachment secured in fixed position to the cup 12 and indicated generally at 14. The cup 12 is open at its upper end and has a substantially circular raised bottom wall 16 and a frustoconical sidewall 18. A substantially flat annular rim 20 integrally connected to the upper marginal edge portion of the sidewall 18 coaxially encircles the open upper end of the cup 12 and defines a radially disposed and upwardly facing annular sealing surface 22 for receiving a lid or diaphragm 24 which is or may be adhered to or otherwise secured in sealing engagement with the surface 22 when the container 10 is used as a sealed package for a product, as, for example, a prepared food product. The entire cup 12 is formed from paper board, virgin stock, solid bleached sulfite which preferably has a thermoplastic polymer coating on both the inner and outer surfaces thereof.

Figure 7:
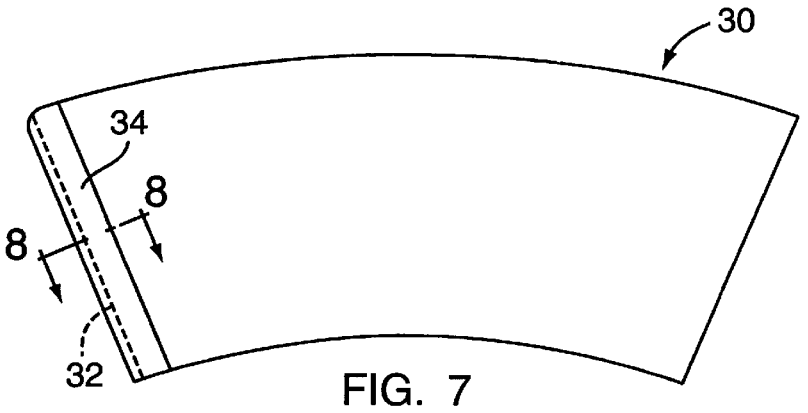
FIG. 7 is a plan view of the container sidewall blank.
Figure 8:
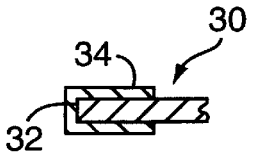
FIG. 8 is a somewhat enlarged fragmentary sectional view taken along the line 8—8 of FIG. 7.
Figure 16:
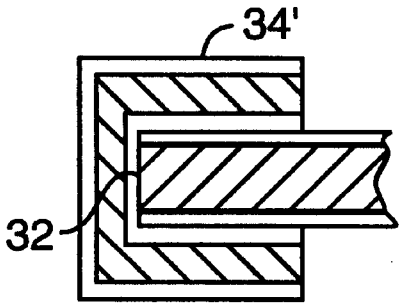
FIG. 16 is similar to FIG. 8, but shown another sealing tape.

Considering now the container assembly 10 in further detail, the cup sidewall is formed from a substantially flat arcuate die cut polymer coated sidewall blank, indicated generally at 30 and shown in FIG. 7. The sidewall blank 30 has raw edges indicated at 32 and 32'. The raw edge 32 is sealed against entry of liquid or moisture by a strip of sealing tape 34 which is sealed to and along marginal edge portions of the sidewall blank 30 adjacent the edge 32, as best shown in FIG. 8. The tape 34 may comprise a strip of a polymer having a relatively low melting point such as polyethylene, but preferably it comprises a carrier strip which may be made from any suitable material such as MYLAR or a foil coated on both sides with a low temperature polymer such as medium or low density polyethylene, as shown in FIG. 16 where a coated tape, indicated at 34' is shown after it has then secured by a heat sealing process to the raw edge 32 of the polymer coated sidewall blank 30. The low temperature polymer tape seals the edge 32 to prevent wicking or migration of liquid from the container and into the container sidewall through the raw edge 32. Thus, the tape seal prevents possible sidewall discoloration or container contamination which might otherwise result from contact of the contents of the container with the raw edge of 32. The tape 34 also facilitates formation of a container sidewall seam as will be hereinafter discussed.

In accordance with the invention the high temperatures polymers may be used as surface coating materials for the container 12. Thus, for example polyester having a melting temperature of about 600 degrees C., polypropylene with a melting temperature of about 300 degrees C. or high density polyethylene with a melting temperature in a general range from 280–300 degrees C., for example, are suitable for use as a surface coating material for the paper used to make the container 12. For present purposes such coating materials will be designated as high temperature polymers. The term "high temperature polymer" as employed in the description and claims which follow is intended to mean any polymer which will not normally attain a melting point within the time/temperature parameters to which it is exposed in a conventional cup making machine operating at a reasonable production rate. Even though the temperatures in the cup making machine reach 1800 degrees C., the polymer coated sidewall and bottom blanks used in making the cup 12 are not normally exposed such high temperatures for a sufficient period of time to reach a melting point while passing through a conventional cup making machine. However, a low temperature polymer, such as polyethylene used in the present cup making process and which has a melting point of about 225 degrees C. will reach a sufficient temperature in passing through a conventional cup making machine to attain a molten state sufficient to allow bonding with any high temperature polymer. Thus, polyethylene or any other polymer having a sufficiently low melting point to allow bonding to occur at normal machine production speeds may be employed as a bonding material for use as a sealing tape, the coating for a tape carrier, or a container blank coating material, as will be hereinafter further discussed. Such polymer coating materials which facilitate bonding during the normal cup making process are herein after designated as a low temperature polymers and will be so designated for convenience in claiming the invention.

Figure 2:
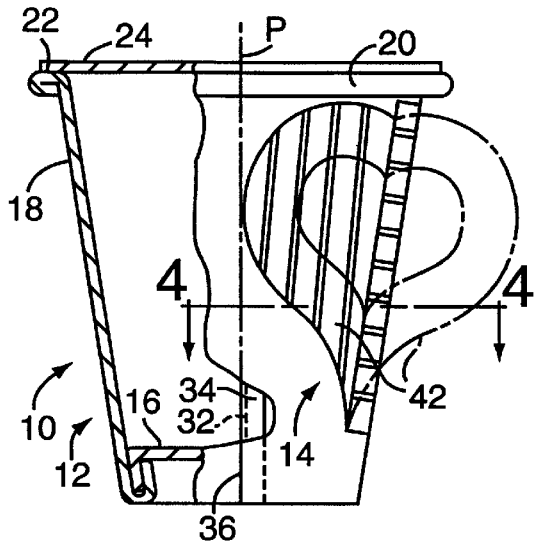
FIG. 2 is a fragmentary side elevational view of the container assembly shown in FIG. 1.
Figure 3:
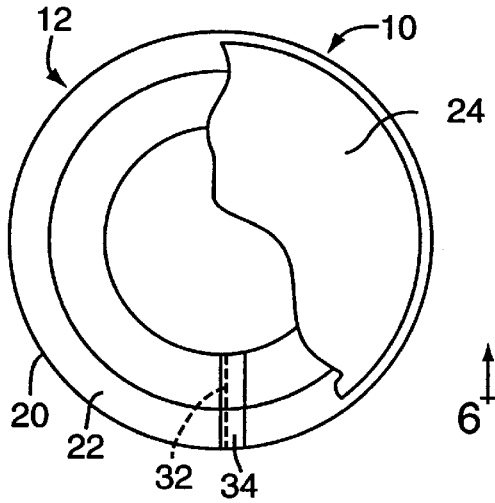
FIG. 3 is a top plan view of the container assembly shown in FIG. 1.
Figure 4:
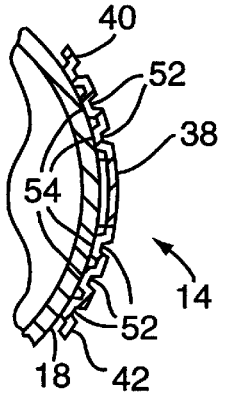
FIG. 4 is a somewhat enlarged fragmentary sectional view taken along the line 4—4 of FIG. 2.

The container or cup 12 is formed in a conventional manner using a cup making machine, such as a rotary turret machine. The cup sidewall 18 is formed by joining the opposite marginal edge portions of the sidewall blank 30 in overlapping face-to-face relation to each other to form a sidewall seam with the taped or sealed edge 32 within the cup and defining a portion of the inner surface of the cup, as best shown in FIG. 2 where the sidewall seam is indicated by the numeral 36. The medium density or low density polyethylene tape 34 enables an improved container sidewall seam 36 and bonds readily to other thermoplastic polymers, having melting points higher than the melting point of medium or low density polyethylene, within the time/temperature parameter available in a conventional cup manufacturing process. The use of medium or low density polyethylene tape 34 at the container sidewall seam enables thee inner surface of the sidewall blank 30 to be coated with any thermoplastic polymer compatible with a food product or the like to be contained within the cup 12. Thus, high temperature polymers such as high density polyethylene, polyester and polypropylene, for example, may be used as a coating material for the inner surface of the container sidewall blank 30.

Figure 5:
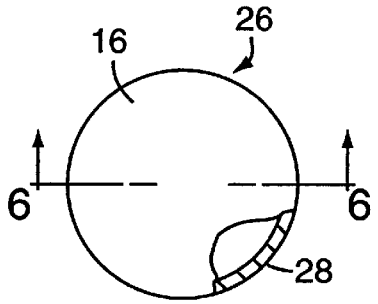
FIG. 5 is a plan view of the container bottom blank.
Figure 6:
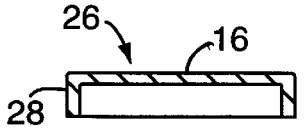
FIG. 6 is a sectional view taken along the line 6—6 of FIG. 5.
Figure 17:
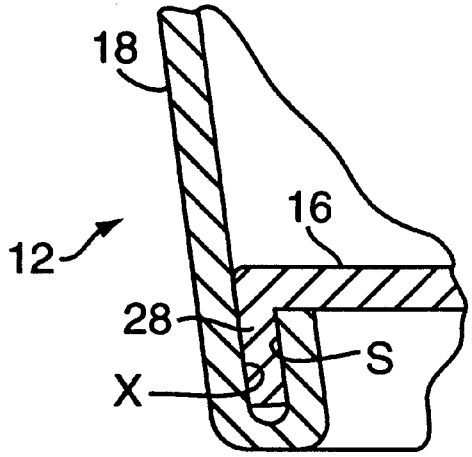
FIG. 17 is a somewhat enlarged fragmentary sectional view similar to FIG. 2 and illustrates the bottom and sidewall construction.

A container bottom which defines the cup bottom wall 16, is cut and drawn from paper board to form a bottom blank indicated generally at 26 in FIGS. 5 and 6. The blank 26 which defines the circular bottom wall 16 also includes an annular skirt 28 which depends from the bottom wall. Since, the cup 12 is assembled by a heat sealing process at least one of the surfaces of the bottom blank 26 is coated with a low temperature polymer such as a medium or low density polyethylene. Thus, for example, if the inner surface of the container, sidewall blank 30, that is the surface which is to define the inner surface of the cup 12, is coated with medium or high density polyethylene, polypropylene or polyester and both surfaces of the container bottom are preferably coated with a low temperature polymer such as medium or low density polyethylene, for example, the outer surface of the low temperature polymer coated skirt 28 on the container bottom 26 is heat sealed in face-to-face relation to an associated portion of the inner surface of the cup sidewall 18 above the lower edge of the sidewall, thereby forming a primary seal at the bottom of the cup. The lower marginal portion of the sidewall blank 30 is rolled and formed inwardly and upwardly into face-to-face relation with the medium or low density polyethylene coated inner surface of the skirt 28 and adhered to the inner surface of the skirt to form a secondary seal at the cup bottom. The aforesaid construction is illustrated in FIG. 17, where the primary seal is indicated by the letter X and the secondary seal is indicated by the letter S.

Figure 18:
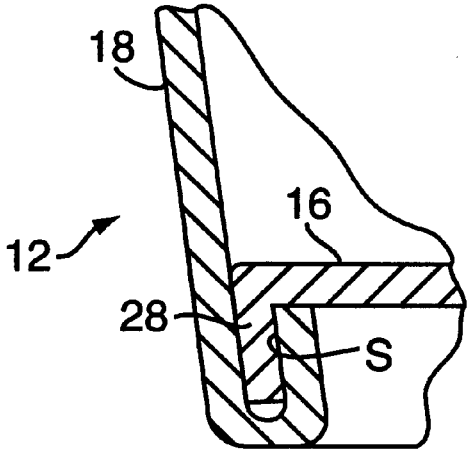
FIG. 18 is similar to FIG. 17, but illustrates another construction.

In FIG. 18 another construction of the cup 10 is illustrated wherein at least the inner surface of the cup sidewall blank 30 is coated with a high temperature polymer and the upper surface of the surface container blank 26 is also coated with a high temperature polymer. Thus, seal can not be established between the inner surface of the cup sidewall 18 and the radially outwardly facing outer surface of the annular skirt 28. For this reason, the bottom surface of the blank 26 is coated with a low temperature polymer so that a secondary seal may be established inwardly and upwardly turned lower portion of the sidewall blank into engagement with the inner surface of the skirt 28. The secondary seal which is formed by bonding the coengaging inner surface of the skirt and the lower marginal surface of the sidewall blank 30 is indicated by the letter S in FIG. 18.

Figure 19:
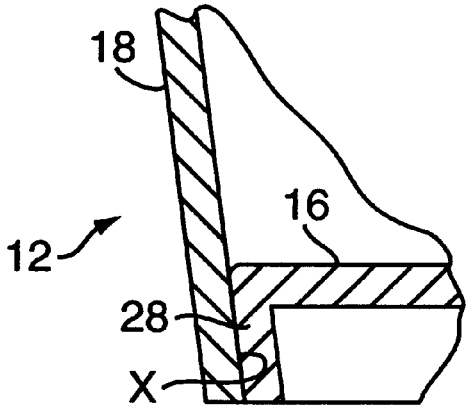
FIG. 19 is similar to FIG. 17, but illustrates yet another construction.

FIG. 19 illustrates yet another construction the cup 12 therein the inner surface of the sidewall blank 30 which forms the inner surface of the cup is coated with a high temperature polymer. In accordance with the illustrated construction at least the upper surface of the bottom blank 26 is coated with a low temperature polymer such as a medium or low density polyethylene. Since the inner surface of the container sidewall 19 is bonded only to the outer surface of the annular skirt 28 the lower edge of the sidewall terminates in registry of the lower edge of the lower skirt, substantially in FIG. 19.

The upper end portion of the sidewall blank 30 is rolled outwardly, downwardly and inwardly to form an annular bead of generally circular cross-section which is thereafter flattened to form the annular rim 20. The flattened bead defines the flat radially disposed sealing surface 22 to which a diaphragm or sealing closure may be attached to seal the open upper end of the container 10.

Figure 9:
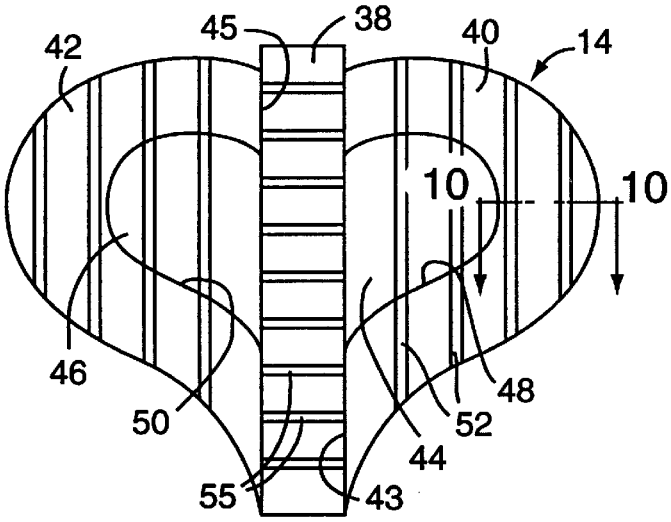
FIG. 9 is a plan view of an insulation/handle attachment blank.
Figure 10:
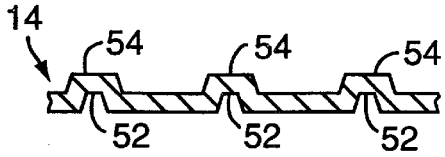
FIG. 10 is a somewhat enlarged fragmentary sectional view taken along the line 10—10 of FIG. 9.

The insulation/handle attachment 14 may be made from any suitable paper stock having sufficient strength to serve as a handle for supporting the container 10 in a filled condition. Referring further to FIGS. 9 and 10, the illustrated insulation/handle attachment 14 is die cut from paperboard stock and includes an elongated generally rectangular central connecting portion indicated at 38 and right and left hand handle sections 40 and 42, respectively, which are integrally attached to opposite sides of the central portion 38 along score or fold lines 43 and 45, substantially as shown. The die cut insulation/handle attachment 14 further includes a pair of cutout portions indicated at 44 and 46 which are integrally connected to the attaching portion 38 and separated from the handles 40 and 42 along die cut lines of separation indicated at 48 and 50, respectively. The insulation/handle attachment 14 further includes a plurality of spaced apart elongated shallow indentations 52, 52 which are produced by a forming or scoring one surface of the blank 14. The latter forming or scoring operation produces corresponding elongated ribs 54, 54 which project from the opposite side of the blank, as shown in FIG. 10. The direction of extent of the indentation 52, 52 and corresponding ribs 54, 54 relative to the insulation/handle attachment is not critical. The illustrated indentations 52, 52 and corresponding ribs 54, 54 extend in generally parallel relation to the direction of extent of the elongated central connecting portion 38. Additional indentations 55, 55 are formed in the central connecting portion 38, extend transversely of the connecting portion, and produce corresponding ribs (not shown) on the opposite side of the central portion 38.

The insulation/handle attachment 14 is applied to the container or cup 12 using a conventional handle applying apparatus of a type well known in the cup making art. The ribs formed by the indentation 55, 55, and which extend transversely of the central portion 38, are disposed in coengagement with the outer surface of the sidewall cup and are adhered to the sidewall surface. The attachment 14 may be fastened to the cup sidewall using a heat sealing process or an appropriate adhesive, such as a hot melt glue. The ribbed surfaces of the cut out portions 44 and 46 are adhesively tacked to the cup sidewall 18. However, it should be noted that the handle sections 40 and 42 are not adhered or otherwise attached to the outer surface of the cup sidewall 18.

In assembly with the cup 12, the saddle-like insulator/handle attachment 14 straddles a portion of the cup sidewall 18. It should be noted that the insulator/handle attachment 14 lies entirely to one side of a diametric plane of the cup 12, such a plane being shown in FIGS. 2 and 3, and indicated by the letter P.

The ribbed configuration of the insulator/handle attachment 14 cooperates with the cup sidewall 18 to provide air spaces between the attachment 14 and the cup sidewall. Thus, the attachment 14 serves as an insulating patch on the cup which provides a region where the cup may be comfortably grasped when it contains a hot or cold substance. Since the handle sections 40 and 42 are not secured to the cup sidewall, these handle portions may be freely moved to a holding position shown in broken lines in FIG. 2. In the latter position portions of the two handle sections are disposed in generally side-by-side relation to each other and form a convenient handle for holding the container. Use of the handle is optional. If the container 10 is used to serve hot soup, for example, it may be preferable not to use the handle, since the cup will normally be resting on a table surface or the like while the hot soup is being consumed. However, if the container is used to serve a hot beverage such as coffee, it may be preferable to use the handle, since the cup will normally be hand held while the beverage is being consumed.

The raised bottom of the container 10 enables the container to be nested with other containers of like kind for convenient storage. The design of the container is such that food may be stored in the container which may be sealed with an appropriate sealing lid or diaphragm, such as the diaphragm 24. Further, the container is suitable for freezing a product which it contains or maintaining the product at refrigeration temperature, as desired. The use of a heavy duty polymeric coating on either or both the inner and outer surface of at least the sidewall of the container renders the container oven friendly so that it may be heated to a reasonable temperature in a conventional convection oven as well as in a microwave oven, if so desired.

Figure 12:
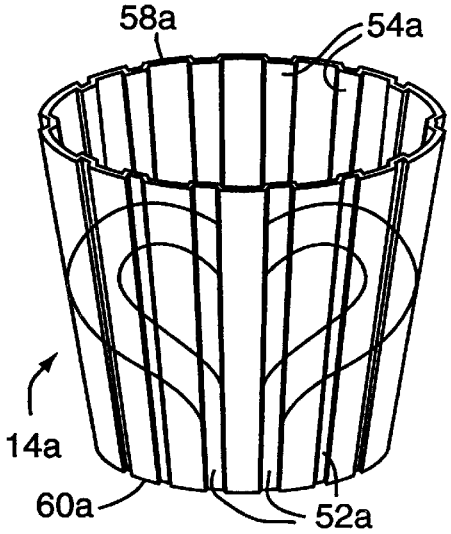
FIG. 12 is a perspective view of the insulation/handle sleeve attachment of the container of FIG. 11.
Figure 11:
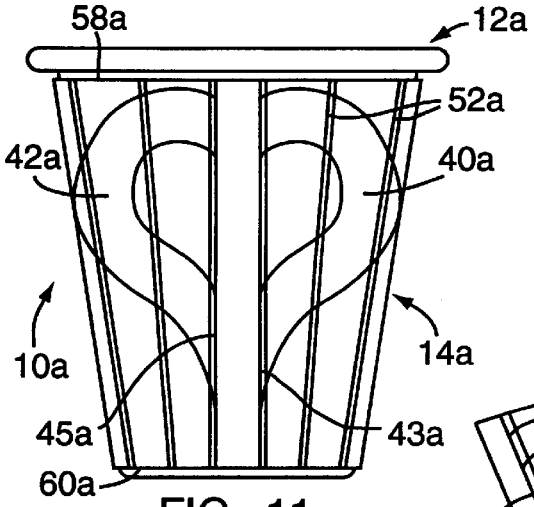
FIG. 11 is a front elevational view of another all-purpose container assembly embodying the present invention.

Referring now to FIGS. 11 and 12 another disposable all-purpose container embodying the present invention is indicated generally by the reference numeral 10*a*. The illustrated container assembly 10*a* comprises a container or cup 12*a* and an insulator/handle attachment designated generally by the reference numeral 14*a*. The container or cup 12*a* is substantially identical in all respects to the container or cup 12, previously described, and for this reason the cup 12*a* will not be further described. However, the insulator/handle assembly designated generally at 14*a* differs substantially from the corresponding insulator/handle assembly 14 previously described. Specifically, the attachment 14*a* substantially comprises an insulating sleeve which includes a handle for optional use.

Figure 13:
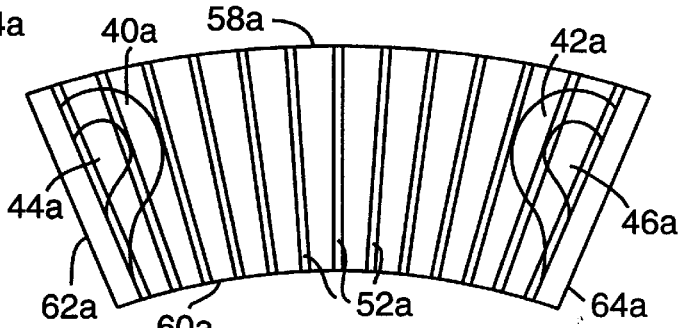
FIG. 13 is a plan view of an insulation/handle sleeve blank.

The illustrated sleeve 14*a* is formed from paperboard by a cutting or blanking operation and has arcuate upper and lower edges indicated by the numerals 58 and 60, respectively. The arcuate upper and lower edges have a common center of curvature but differing radii of curvature. The blank is further defined by radially extending opposite end edges 62*a* and 64*a* centered at the common center of curvature. A plurality of spaced apart and shallow radially extending indentations 52*a*, 52*a* formed in one surface of the sleeve blank produce corresponding radially extending ribs 54*a*, 54*a* which project from the opposite or inner surface of the sleeve blank as shown in FIG. 13. The blank 14*a* also includes two die cut handle sections 40*a* and 42*a*. Each of the handle sections 42 and 42*a* is integrally connected to a marginal end portion of the blank 14*a* in spaced relation to an associated end edge of the blank, substantially as shown in FIG. 13. The cutout portions of the handle sections, indicated at 44*a* and 46, may, if desired, be removed from the sleeve blank. The sleeve 14*a* is formed by adhesively joining the marginal end portions of the sleeve blank in overlying face-to-face relation to each other. The frustoconical insulation/handle sleeve 14*a* is preferably formed as a separate unit from the cup 12*a* to be slipped onto the cup when the cup is used. It will be noted that the handle sections 40*a* and 42*a* are adjacent the sleeve seam formed by the overlapping marginal portions 62*a* and 64*a*. Thus, the double thickness seam imparts both strength and insulation qualities to the handle.

Figure 14:
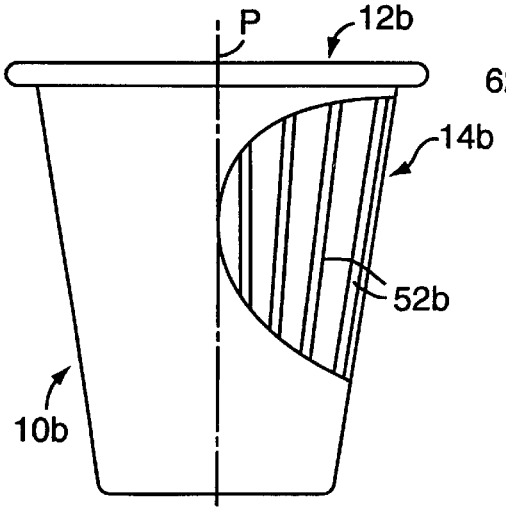
FIG. 14 is a side elevational view of still another all-purpose container embodying the present invention.
Figure 15:
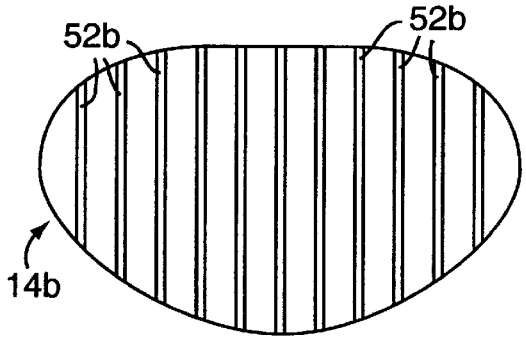
FIG. 15 is a plan view of the insulating blank attachment of the container shown in FIG. 14.

Another disposable all-purpose container assembly embodying the present invention is shown in FIGS. 14 and 15 and indicated generally by the referenced numeral 10*b*. The illustrated cup 12*b* is substantially identically to the cup 12 previously described. However, the insulation attachment 14*b* does not include a handle and essentially comprises a patch of paperboard attached to the cup to provide an insulated region of somewhat limited area to facilitate comfortable handling of a cup which may contain a heated or frozen product, for example. The saddle-like attachment or patch 14*b* may take various forms. However, the patch 14*a* is preferably constructed and arranged to straddle an associated portion of the cup 12*b* and lie entirely to one side of diametric plane through the cup, such a plane being indicated by the letter P in FIG. 14. A typical insulation attachment or patch 14*b* shown in FIG. 15 may be made from any suitable paperboard material and includes a plurality of spaced apart indentations 52*b*, 52*b* formed in one surface of the material thereby producing ribs projecting from the opposite surface of the patch, but not shown. The patch 14*b* is adhered to the cup 12*b* with the ribs engaging the outer surface of the cup sidewall so that air spaces are provided between the cup sidewall, the inner surface of the patch, and each pair of adjacent ribs, whereby an associated portion of the cup is insulated to facilitate comfortable handling.

I claim:

1. A disposable all-purpose container assembly comprising; a container formed from polymer coated paper and having a bottom wall and a sidewall having inner and outer surfaces and including an integral annular rim defining an opening at an upper end of said container, said sidewall having a high temperature polymer coating on said inner surface and first and second raw edges at opposite ends thereof, a strip of low temperature polymer sealing tape extending along and sealing said first raw edge and bonded to said high temperature polymer coated inner surface and to said outer surface of said sidewall along marginal portions of said sidewall adjacent said first raw edge, said sidewall having a seam formed by the overlapping face-to-face joinder of marginal portions of the sealed first raw edge and said second raw edge, said sealed first raw edge being disposed within said container, said bottom wall having polymer coated top and bottom surfaces, at least one of said surfaces including said top and bottom surfaces being coated with a low temperature polymer, said high temperature polymer coated inner surface of said sidewall, being bonded to said at least one of said surfaces.

2. A disposable all-purpose container assembly as set forth in claim 1 wherein said sealing tape comprises a low-density polyethylene tape.

3. A disposable all-purpose container assembly as set forth in claim 1 wherein said sealing tape comprises a carrier strip coated on both sides with a low temperature polymer.

4. A disposable all-purpose container assembly as set forth in claim 3 wherein said polymer comprises polyethylene.

5. A disposable all-purpose container assembly as set forth in claim 3 wherein said carrier strip comprises a foil.

6. A disposable all-purpose container assembly as set forth in claim 3 wherein said carrier strip comprises MYLAR.

7. A disposable all-purpose container assembly as set forth in claim 1 wherein said high temperature polymer coating comprises polyester.

8. A disposable all-purpose container assembly as set forth in claim 1 wherein said high temperature polymer coating has a melting temperature of about 600 degrees C.

9. A disposable all-purpose container assembly as set forth in claim 1 wherein said high temperature polymer coating comprises a high density polyethylene coating having a melting temperature in a general range from 280 to 300 degrees C.

10. A disposable all-purpose container assembly comprising: a container formed from polymer coated paper and having an opening at an upper end, said container including a container sidewall formed from a sidewall blank having inner and outer surfaces, said sidewall blank having a high temperature polymer coating on said inner surface and first and second raw edges at opposite ends thereof, a strip of low temperature polymer sealing tape extending along and sealing said first raw edge and bonded to said high temperature polymer coated inner surface and to said outer surface of said sidewall blank along marginal portions of said sidewall blank adjacent said first raw edge, said container sidewall having a seam formed by overlapping face-to-face bonded joinder of taped marginal portions of the sealed first raw edge and said second raw edge, said sealed first raw edge being disposed within said container, said container having a bottom wall and an annular skirt depending from said bottom wall and formed from a bottom wall blank having polymer coated top and bottom surfaces, said annular skirt having a polymer coated outer surface defined by said top surface and a polymer coated inner surface defined by said bottom surface, at least one of said surfaces including said top surface and said bottom surface being coated with a low temperature polymer, said high temperature polymer coated inner surface of said container sidewall being bonded to said at least one of said surfaces including said inner surface and said outer surface.

11. A disposable all-purpose container assembly as set forth in claim 10 wherein said at least one of said surfaces comprises said top surface and said inner surface of said sidewall is bonded to said outer surface of said skirt to form a primary seal at the bottom of said container.

12. A disposable all-purpose container assembly as set forth in claim 11 wherein said container sidewall terminates at a lower edge in registry with a lower edge of said skirt.

13. A disposable all-purpose container assembly as set forth in claim 10 wherein said top surface of said bottom wall blank is coated with a high temperature polymer coating and said bottom surface of said bottom wall blank comprises said at least one of said surfaces and said container sidewall has a lower marginal portion turned upwardly and into engagement with said inner surface of said annular skirt and said inner surface of said annular skirt is bonded to said upwardly turned marginal portion of said container sidewall to form a secondary seal at the bottom of said container body.

14. A disposable all-purpose container assembly as set forth in claim 10 wherein both said top and bottom surfaces of said bottom wall blank are coated with a low temperature polymer, said container sidewall has an upwardly turned lower marginal portion disposed in engagement with said inner surface of said annular skirt and said inner surface of said container sidewall is bonded to said outer surface of said annular skirt forming a primary seal at the bottom of said container and bonded to the inner surface of said annular skirt forming a secondary seal at a lower end of said container.

* * * * *